US010384911B2

(12) United States Patent
Saperstein et al.

(10) Patent No.: US 10,384,911 B2
(45) Date of Patent: Aug. 20, 2019

(54) ELEVATOR SYSTEM HAVING LOCKDOWN MODE

(71) Applicant: Otis Elevator Company, Farmington, CT (US)

(72) Inventors: Mark D. Saperstein, Simsbury, CT (US); Benjamin Saperstein, Bloomfield, CT (US); Donald Hagney, Bloomfield, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 17 days.

(21) Appl. No.: 15/282,248

(22) Filed: Sep. 30, 2016

(65) Prior Publication Data

US 2018/0093860 A1 Apr. 5, 2018

(51) Int. Cl.

| | |
|---|---|
| ***B66B 5/02*** | (2006.01) |
| ***B66B 1/28*** | (2006.01) |
| ***B66B 19/00*** | (2006.01) |
| ***B66B 5/00*** | (2006.01) |
| *B66B 9/00* | (2006.01) |

(52) U.S. Cl.

CPC ..... *B66B 5/021* (2013.01); *B66B 1/28* (2013.01); *B66B 5/0012* (2013.01); *B66B 19/007* (2013.01); *B66B 9/00* (2013.01)

(58) Field of Classification Search

USPC ..... 187/247

See application file for complete search history.

(56) References Cited

U.S. PATENT DOCUMENTS

| | | | | |
|---|---|---|---|---|
| 4,839,631 | A * | 6/1989 | Tsuji | G08B 13/00 187/392 |
| 5,131,508 | A * | 7/1992 | Suzuki | B66B 5/0012 187/380 |
| 5,159,163 | A | 10/1992 | Bahjat et al. | |
| 5,692,446 | A | 12/1997 | Becker et al. | |
| 6,948,592 | B2 * | 9/2005 | Kavounas | A61N 1/39 187/384 |
| 7,182,174 | B2 | 2/2007 | Parrini et al. | |
| 7,280,030 | B1 | 10/2007 | Monaco | |
| 7,529,646 | B2 | 5/2009 | Lin et al. | |
| 7,823,703 | B2 * | 11/2010 | Amano | B66B 5/0012 187/247 |
| 7,823,704 | B2 * | 11/2010 | Amano | B66B 5/0012 187/247 |

(Continued)

FOREIGN PATENT DOCUMENTS

| | | | |
|---|---|---|---|
| CN | 105000443 | A | 10/2015 |
| CN | 105060052 | A | 11/2015 |

(Continued)

OTHER PUBLICATIONS

European Search Report for application EP 17194353.3, dated Feb. 23, 2018, 12 pages.

*Primary Examiner* — Christopher Uhlir
(74) *Attorney, Agent, or Firm* — Cantor Colburn LLP

(57) ABSTRACT

An elevator system includes an elevator car configured to travel in a hoistway; an elevator car door configured to open and close; a machine configured to impart force to the elevator car; an interface configured to generate a lockdown mode signal; and a controller configured to control operation of at least one of the machine and the elevator car door in response to the lockdown mode signal.

14 Claims, 4 Drawing Sheets

(56) References Cited

U.S. PATENT DOCUMENTS

| | | | | |
|---|---|---|---|---|
| 7,832,527 | B2 * | 11/2010 | Amano | B66B 5/0012 187/392 |
| 7,837,013 | B2 * | 11/2010 | Amano | B66B 5/0012 187/392 |
| 7,963,372 | B2 * | 6/2011 | Hikita | B66B 5/024 187/313 |
| 8,230,980 | B2 | 7/2012 | Mason | |
| 8,763,761 | B2 | 7/2014 | Siikonen | |
| 8,857,569 | B2 | 10/2014 | Friedli | |
| 2007/0151808 | A1 | 7/2007 | Amano | |
| 2012/0047083 | A1 | 2/2012 | Qiao et al. | |
| 2013/0168191 | A1 * | 7/2013 | Mason | B66B 5/0012 187/392 |
| 2014/0365574 | A1 | 12/2014 | Franks et al. | |
| 2015/0170486 | A1 | 6/2015 | Penland | |

FOREIGN PATENT DOCUMENTS

| | | | |
|---|---|---|---|
| EP | 1873108 | A1 | 1/2008 |
| GB | 2267977 | A | 12/1993 |
| JP | 2011063416 | A | 3/2011 |
| WO | 2009068706 | A1 | 6/2009 |
| WO | 2015184217 | A1 | 12/2015 |
| WO | 2015184219 | A1 | 12/2015 |

* cited by examiner

ELEVATOR SYSTEM HAVING LOCKDOWN MODE

BACKGROUND

The subject matter disclosed herein generally relates to elevator systems and, more particularly, to an elevator system operable in a lockdown mode.

Facilities, such as office buildings, hospitals, university campuses, etc. often have the need for lockdown procedures in the event of civil unrest, violence, terrorist attack, or other emergency situation. Example lockdown procedures may instruct occupants to proceed to a safe area and await first responders. Such procedures may also entail locking doors, closing window shades, reducing noise, etc. Existing lockdown procedures focus on instructing individuals on where to go and how to act, but are lacking in control of transportation systems, such as elevator systems.

BRIEF SUMMARY

According to one embodiment, an elevator system includes an elevator car configured to travel in a hoistway; an elevator car door configured to open and close; a machine configured to impart force to the elevator car; an interface configured to generate a lockdown mode signal; and a controller configured to control operation of at least one of the machine and the elevator car door in response to the lockdown mode signal.

In addition to one or more of the features described above, or as an alternative, further embodiments may include wherein when the lockdown mode signal is active, the controller controls operation of at least one of the machine and the elevator car door in response to a lockdown mode parameter.

In addition to one or more of the features described above, or as an alternative, further embodiments may include wherein the lockdown mode parameter comprises an operation activation parameter, the operation activation parameter indicating collective or individual elevator car control.

In addition to one or more of the features described above, or as an alternative, further embodiments may include, wherein the lockdown mode parameter comprises an elevator car identifier parameter, the elevator car identifier parameter indicating at least one of: all elevator cars, groups of elevator cars or individually selected elevator cars.

In addition to one or more of the features described above, or as an alternative, further embodiments may include wherein the lockdown mode parameter comprises an elevator car travel parameter to control elevator car travel when lockdown mode is active.

In addition to one or more of the features described above, or as an alternative, further embodiments may include wherein the elevator car travel parameter indicates at least one of: stop at next available landing; stop at next called landing; recall to a specified landing, recall to lobby, travel between non-lockdown landings.

In addition to one or more of the features described above, or as an alternative, further embodiments may include wherein the lockdown mode parameter comprises an elevator car door parameter to control the elevator car door when lockdown mode is active.

In addition to one or more of the features described above, or as an alternative, further embodiments may include wherein the elevator car door parameter indicates at least one of: elevator car door remains closed; elevator car door remains opened; elevator car door closes and remains closed; elevator car door opens and remains open; elevator car door open button enable/disable; elevator car door close button enable/disable; remote elevator car door open button enable; remote elevator car door close button enable.

In addition to one or more of the features described above, or as an alternative, further embodiments may include wherein the lockdown mode parameter comprises an announcement parameter, the announcement parameter indicating that an announcement is to be made.

In addition to one or more of the features described above, or as an alternative, further embodiments may include wherein the announcement parameter indicates at least one of: no announcement, an announcement throughout a facility and an announcement in the elevator car.

In addition to one or more of the features described above, or as an alternative, further embodiments may include wherein the lockdown mode parameter comprises a lockdown mode exit parameter, the lockdown mode exit parameter indicating operation of at least one of the machine and the elevator car door when the lockdown mode signal changes from active to inactive.

In addition to one or more of the features described above, or as an alternative, further embodiments may include a user interface configured to input the lockdown mode parameter.

In addition to one or more of the features described above, or as an alternative, further embodiments may include wherein the controller suspends operation of the machine and the elevator car door in response to the lockdown mode parameter.

In addition to one or more of the features described above, or as an alternative, further embodiments may include wherein the controller controls the machine to move the elevator car to a predetermined floor in response to the lockdown mode parameter.

In addition to one or more of the features described above, or as an alternative, further embodiments may include wherein the controller moves the elevator car to stop in between landings in response to the lockdown mode parameter.

According to another embodiment, a method for controlling an elevator system having a machine, an elevator car and an elevator car door includes receiving, at an interface, a lockdown mode parameter; storing, by a controller, the lockdown mode parameter; monitoring, by the controller, a lockdown mode signal; and when the lockdown mode signal is active, the controller controlling operation of at least one of the machine and the elevator car door in response to the lockdown mode parameter.

In addition to one or more of the features described above, or as an alternative, further embodiments may include when the lockdown mode signal is inactive, exiting lockdown mode operation in response to the lockdown mode parameter.

In addition to one or more of the features described above, or as an alternative, further embodiments may include wherein in the lockdown mode parameter comprises a lockdown mode exit parameter, the lockdown mode exit parameter indicating operation of at least one of the machine and the elevator car door when the lockdown mode signal changes from active to inactive.

Technical effects of embodiments of the present disclosure include the ability to assign lockdown mode parameters for an elevator system and operate the elevator system in accordance with the lockdown mode parameters when a lockdown mode is in effect.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
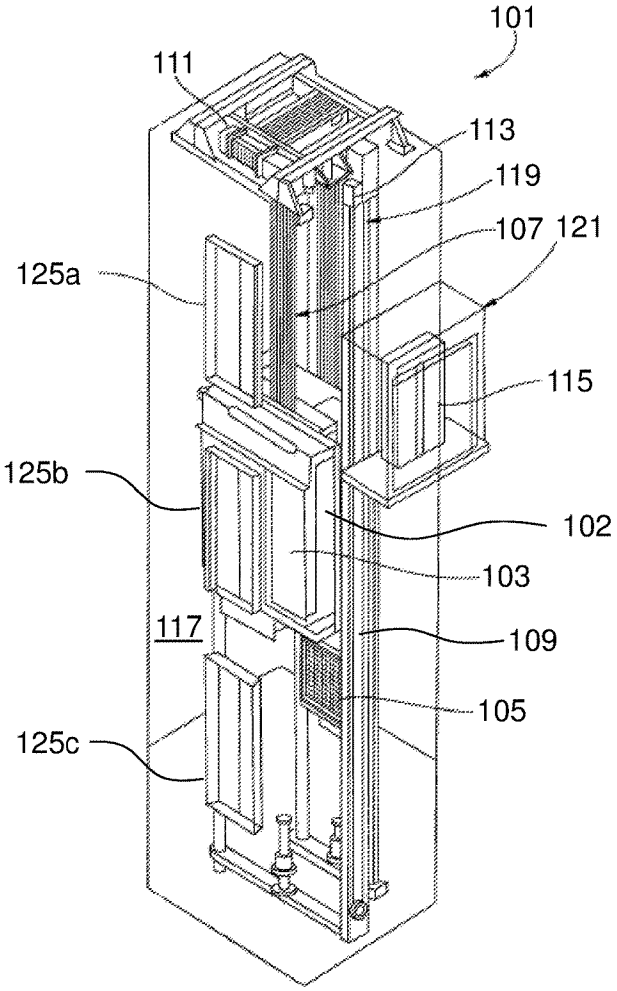
FIG. 1 depicts an elevator system in an embodiment.

FIG. 1 is a perspective view of an elevator system 101 including an elevator car 102, a counterweight 105, a roping 107, a guide rail 109, a machine 111, a position encoder 113, and a controller 115. The elevator car 102 and counterweight 105 are connected to each other by the roping 107. The roping 107 may include or be configured as, for example, ropes, steel cables, and/or coated-steel belts. The counterweight 105 is configured to balance a load of the elevator car 102 and is configured to facilitate movement of the elevator car 102 concurrently and in an opposite direction with respect to the counterweight 105 within an elevator hoistway 117 and along the guide rail 109.

The roping 107 engages the machine 111, which is part of an overhead structure of the elevator system 101. The machine 111 is configured to control movement of the elevator car 102 and the counterweight 105. The position encoder 113 may be mounted on an upper sheave of a speed-governor system 119 and may be configured to provide position signals related to a position of the elevator car 102 within the elevator hoistway 117. In other embodiments, the position encoder 113 may be directly mounted to a moving component of the machine 111, or may be located in other positions and/or configurations as known in the art.

The controller 115 is located in a controller room 121 of the elevator hoistway 117 and is configured to control the operation of the elevator system 101, and particularly the elevator car 102. For example, the controller 115 may provide drive signals to the machine 111 to control the acceleration, deceleration, leveling, stopping, etc. of the elevator car 102. The controller 115 may also be configured to receive position signals from the position encoder 113. When moving up or down within the elevator hoistway 117 along guide rail 109, the elevator car 102 may stop at one or more landings 125*a*, 125*b* and 125*c* as controlled by the controller 115. The elevator system may serve more or less than three floors. The controller 115 may also be configured to control the elevator car door 103. The controller 115 may open or close the elevator car door 103 and may enable or disable the elevator car door open and close buttons inside elevator car 102. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator hoistway 117 may employ embodiments of the present disclosure. For example, the elevator system 101 may use a ropeless machine for moving the elevator car 102 along the hoistway 117. Also, although a single elevator car 102 is shown, it is understood that the elevator system 101 may include a plurality of elevator cars 102, under the control of a single controller 115. Further, the controller 115 may be divided into a plurality of group controllers, each controller responsible for a single car or a group of elevator cars 102. In one embodiment, the elevator system 101 may include multiple elevator cars operating within the same elevator hoistway 117. FIG. 1 is a non-limiting example presented for illustrative and explanatory purposes.

Figure 2:
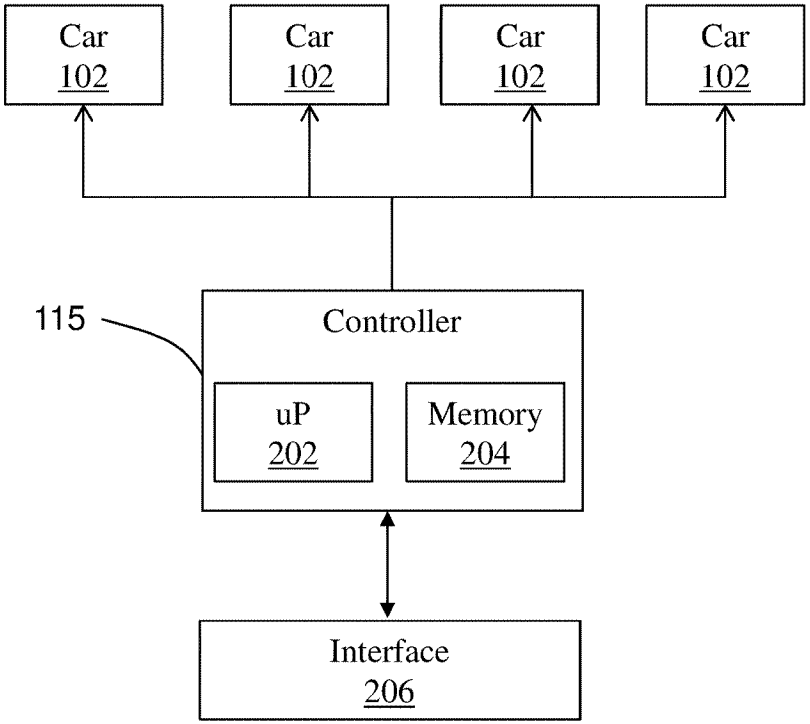
FIG. 2 depicts system for controlling an elevator system in an embodiment.

FIG. 2 depicts a system for controlling the elevator system 101 in an embodiment. As shown in FIG. 2, the controller 115 includes a processor 202 and a memory 204, which may store executable instructions and/or data. The executable instructions may be stored or organized in any manner and at any level of abstraction, such as in connection with one or more applications, processes, routines, procedures, methods, etc. The instructions stored in the memory 204 may be executed by the processor 202. The memory 204 may also store lockdown mode parameters, as described in detail below, that define how the elevator system 101 is to operate during the occurrence of a lockdown.

An interface 206 is coupled to the controller 115. The interface 206 may be implemented using known input/output devices which may include one or more of a keyboard or keypad, a key switch, a touchscreen or touch panel, a display screen, a microphone, a speaker, a mouse, a button, a remote control, a joystick, a printer, a telephone or mobile device (e.g., a smartphone), etc. The user interface 206 may be remote from the controller 115 and coupled to the controller 115 by a network connection (e.g., wired and/or wireless). In one embodiment, the interface 206 may be in wired connection to the controller 115. The architecture shown in FIG. 2 depicts a single interface 206 and a single controller 115. In other embodiments, a plurality of controllers may be used, each controller having an interface and controlling one or more elevator cars 102.

The interface 206 generates a lockdown mode signal as an output signal to the controller 115. The lockdown mode signal initiates the lockdown mode and indicates whether the facility, where the elevator system 101 is installed, is in lockdown mode. The lockdown mode signal is active if the facility is currently in lockdown mode, and inactive if the facility is currently not in lockdown mode, also referred to as normal operating mode. The lockdown mode may be initiated for a variety of reasons, including a natural disaster, an intruder, civil disturbance, etc.

The lockdown mode signal may be activated in a variety of ways from the interface 206. In one embodiment, the lockdown mode signal is activated by a button or key enabled switch on a security panel in communication with the interface 206. In another embodiment, a portable, electronic "panic button" may be used to authorize the interface 206 to place the lockdown mode signal in active status. In these embodiments, a person is activating the lockdown mode signal generated by the interface 206. The person may have a particular role, such as a building manager, fire, police, first responder, EMT, etc. By way of example, the input device at the interface 206 can be operated by security personnel at a security desk, by building executives at any landing, by first responders at specified locations, or by anyone if an input device is available and the situation warrants this behavior. The interface 206 may require authentication (e.g., a password, code, etc.) of an input requesting that the lockdown mode signal be activated.

In other embodiments, the interface 206 activates the lockdown mode signal in response to a signal from detection devices. Devices, such as acoustic detectors, can automatically determine that lockdown condition exists and send a command to the interface 206 to output an active lockdown mode signal. Such detectors may detect an audible lockdown alarm, gunshot(s), a lockdown voice command (from authorized personnel), etc. Other devices may use cameras to detect a flash of a firearm discharge and provide a location signal.

A single interface 206 is shown in FIG. 2, but it is understood that the interface 206 may be distributed across multiple locations, including locations remote from the building housing the elevator system 101. Further, multiple types of interfaces 206 may be connected to controller 115 and capable of outputting an active lockdown mode signal. In one embodiment, the interface 206 includes a panel in a security office of a building. The interface 206 may also include one or more of an elevator user interface or joint interface, to initiate lockdown mode. Thus, the interface 206 is intended to cover a variety of devices that produce a lockdown mode signal. If the lockdown mode signal is active, the controller 115 alters operation of the elevator system 101.

The interface 206 allows a user to specify how the controller 115 will function when the lockdown mode signal is active by identifying lockdown mode parameters. A building operator can specify the lockdown mode parameters at setup of the elevator system 101. The lockdown mode parameters can be changed at any point. The interface 206 may also be implemented using a service tool, either alone or in combination with a service panel or other device.

Figure 3:
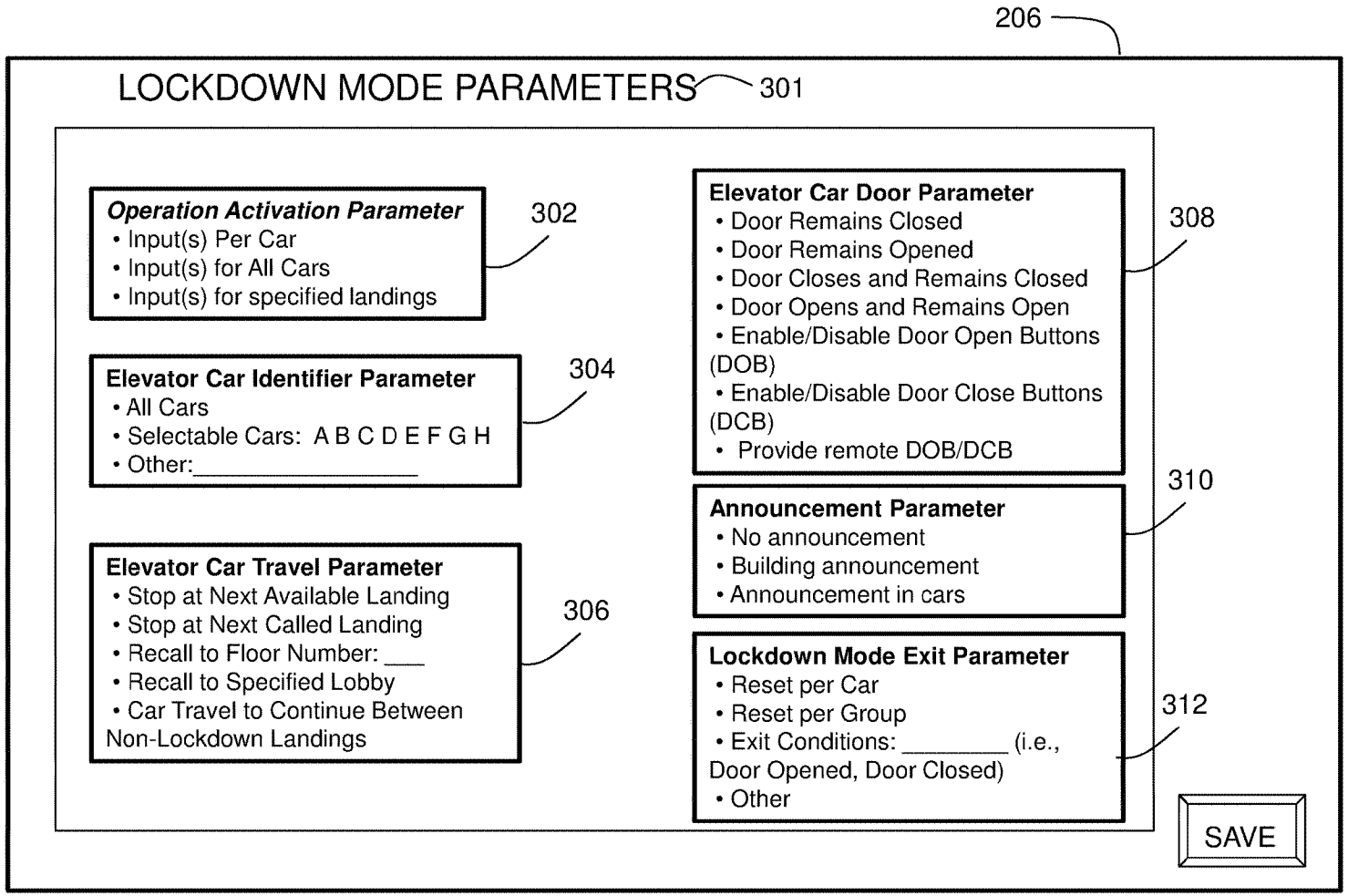
FIG. 3 depicts a user interface for specifying lockdown mode parameters in an embodiment.

FIG. 3 depicts an interface 206 for specifying lockdown mode parameters 301 in an embodiment. The interface 206 of FIG. 3 provides a variety of lockdown mode parameters 301, including operation activation parameters 302, elevator car identifier parameters 304, elevator car travel parameters 306, elevator car door parameters 308, announcement parameters 310 and lockdown mode exit parameters 312. It is understood that the lockdown mode parameters 301 are examples, and other lockdown mode parameters may be used to control the elevator system 101 during a lockdown.

The operation activation parameters 302 allow the user to specify how the lockdown mode will be initiated in the event of a lockdown, including a per car input for one or all cars, a single input to activate all cars or those specified by 304, and inputs for one car or all cars at one or more landings. Control commands from the controller 115 may be issued to all the elevators cars as a group, or individually to each elevator car, as determined by the operation activation parameters 302.

Several modes of operation are available for any car commanded to enter the lockout operation as established by using a combination of the available parameters. For example, all cars can be used to handle passenger travel and stopped safely at the next available landing 306 or at a specified landing 306, open the doors 308 and allow the passengers to exit or keep the doors closed 308 and retain all passengers. The cars can be disabled from further motion and all door control disabled 308. Also, all cars can be used to entrap a perpetrator by immediately disabling door control, stopping the car safely at the next available landing or bringing the car to a predetermined landing where remote activation of the door can be controlled when safe to do so.

The elevator car identifier parameters 304 allow the user to specify which elevator cars 102 are controlled in lockdown mode, including all elevator cars, groups of elevator cars or individually selected elevator cars. The elevator car identifier parameters 304 identify how the presence or absence of the lockdown mode is communicated through the elevator system 101. For example, is lockdown mode is initiated at one elevator car 102 (as identified by the operation activation parameters 302), communication between the elevators cars 102 can allow for other elevator cars 102, as defined by the elevator car identifier parameters 304, to enter the lockdown operation.

The elevator car travel parameters 306 indicate how the elevator cars 102 will be controlled in lockdown mode. The elevator car travel parameters 306 include stop at next available landing; stop at next called landing; recall to a specified landing, recall to lobby and allow continual travel between non-lockdown landings. During a lockdown, certain landings may be inaccessible as being locked down, referred to as lockdown landings.

The elevator car door parameters 308 indicate how the elevator car doors 103 will be controlled in lockdown mode. The elevator car door parameters 308 include elevator car door remains closed; elevator car door remains opened; elevator car door closes and remains closed; elevator car door opens and remains open; elevator car door open button enable/disable; elevator car door close button enable/disable; remote elevator car door open button enable; remote elevator car door close button enable. The elevator car door parameters 308 allow for control of individuals in the building. For example, if the elevator car doors 103 are commanded to remain in a present state, this further prevents access to elevator cars 102 (e.g., open doors remain open and closed doors remain closed). Closing open elevator car doors 103 can both provide one or more safe zones and restrict movement of all individuals in the building. The elevator car door parameters 308 can provide for access and egress to cars after the safe travel of passengers or the restriction of access and egress to enable the entrapment of passengers. For example, if when arriving at a landing the doors open to allow passengers to exit they may be kept open or allowed to close to prevent further access. Also, as an example, open car doors may be closed immediately when the lockdown mode is initiated and the door control from within the car could be disabled to entrap a person inside the elevator.

The announcement parameters 310 indicate whether and how an announcement of the lockdown should be made. The announcement parameters 310 include not make any announcement, making an announcement in the elevator cars, and making an announcement throughout the whole facility (e.g., by sending a signal to a public address system). The lockdown mode exit parameters 312 indicate what events are to occur for the lockdown mode to be exited. The lockdown mode exit parameters 312 include: reset each elevator car individually, reset groups of elevator cars, specified exit conditions such as door state (opened/closed) or other user-specified operations. For example, if a single input is required to activate the operation in a single car or a group of cars, that single input when deactivated will allow for the single car or group of cars to exit lockdown operation. If multiple inputs are required to activate the operation in multiple cars, or at multiple landings, all inputs must be deactivated for all cars to exit from lockdown operation. It is possible that a single input can initiate lockdown operation in multiple cars and inputs per car can allow a single car to exit from lockdown operation.

By adjusting the lockdown mode parameters 301, a wide variety of elevator operations are available during lockdown mode. In one example, the lockdown mode parameters 301 cause all elevator operations to be suspended in lockdown mode. In another example, the lockdown mode parameters 301 cause all elevator cars to bring all passengers to a predetermined floor. In another example, the lockdown mode parameters 301 cause the elevator cars to stop in between landings, so that no one can enter or exit the elevators cars.

Figure 4:
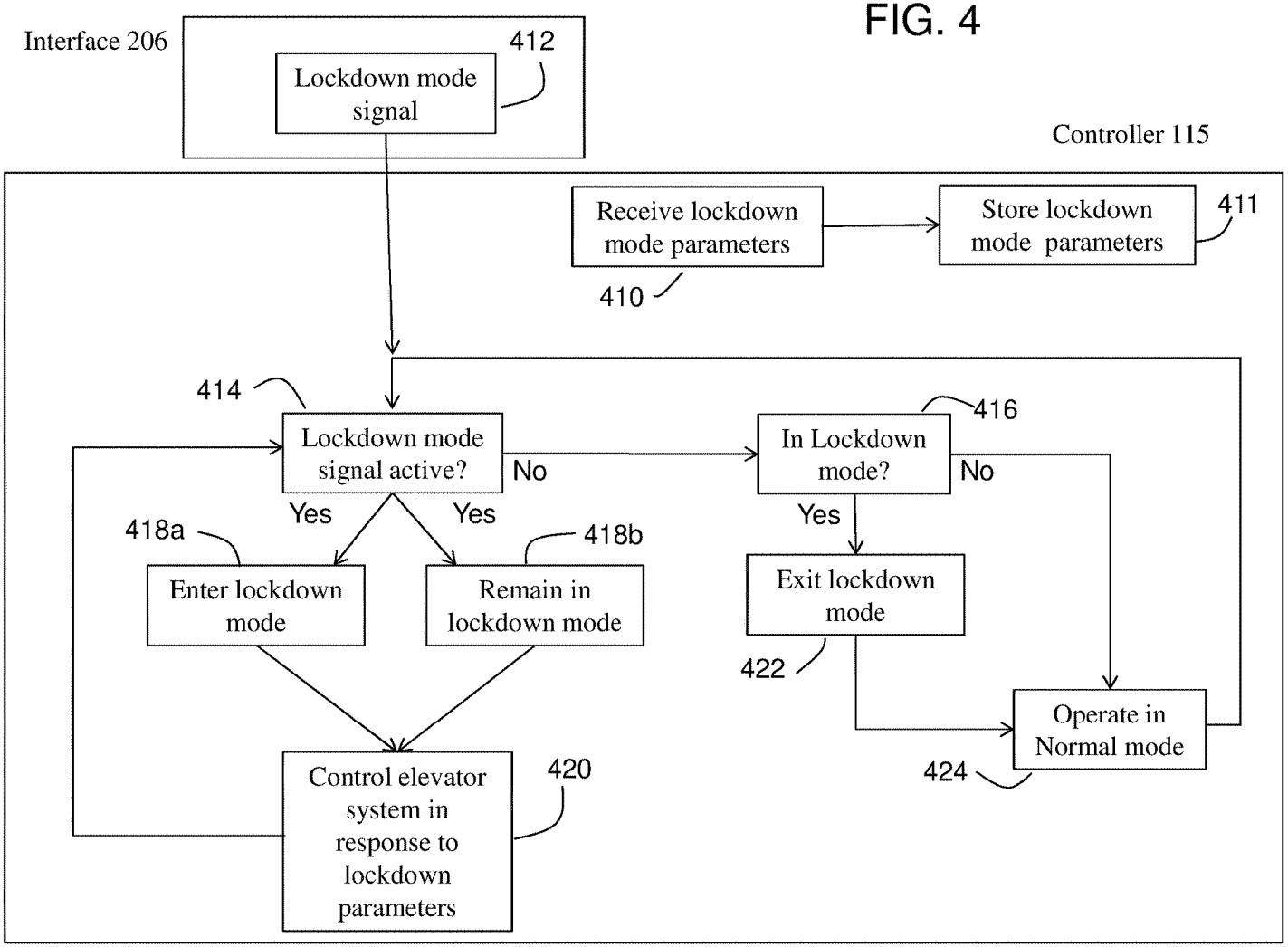
FIG. 4 depicts a method for controlling an elevator system in an embodiment.

The controller 115 executes a process to control the elevator system 101 as shown in FIG. 4. At 410, the controller 115 receives the lockdown mode parameters from the interface 206, such as that shown in FIG. 3. At 411, the controller 115 stores the lockdown mode parameters in memory 204. At 414, the controller 115 monitors the lockdown mode signal 412 from the interface 206. If the lockdown mode signal is not active, flow proceeds to 416 where the controller 115 determines if the car was in lockdown mode. If not, the controller 115 operates the elevator system 101 in normal operating mode at 424. If so, the lockdown mode is exited 422, and the car returns to operate in normal mode at 424. Blocks 414, 416, and 424 repeat until the lockdown mode signal is active and flow proceeds to 418*a* or 418*b* where the controller 115 enters or remains in lockdown mode, respectively. At 420, the controller 115 controls operation of the elevator system 101 in response to the lockdown mode parameters 301 stored in memory 204. Flow proceeds to 414 where the controller 115 determines if the lockdown signal is still active. If so, flow continues to 418*a* or 418*b*. If not and the exit conditions as specified in the lockdown mode exit parameters 312 are met, flow proceeds to 416. At 416, if the lockdown signal was previously active, the controller 115 exits lockdown mode by performing the operation as specified in the lockdown mode exit parameters 312. Once lockdown mode is exited, flow proceeds to 424. In the process to control the elevator system 101 shown in FIG. 4 the lockdown mode parameters are stored at 411 and are not altered. As noted above, the lockdown mode parameters may be updated periodically and then stored in memory 204. In other embodiments, the lockdown mode parameters changed when the lockdown mode signal from interface 206 is active. For example, at 420 of FIG. 4, the lockdown mode parameters may be updated or changed, even if the lockdown mode signal from interface 206 is active.

Embodiments allow a user to specify lockdown mode parameters at an elevator controller, which are then used to operate the elevator system in lockdown mode. The lockdown mode parameters provide multiple settings relating to elevator car motion control and elevator car door control that will enable a facility to enact a specified operation(s) as defined by that jurisdiction or property to allow for the elevator car(s) to be moved and controlled appropriately.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. An elevator system comprising:

an elevator car configured to travel in a hoistway;

an elevator car door configured to open and close;

a machine configured to impart force to the elevator car;

an interface configured to generate a lockdown mode signal; and a controller configured to control operation of at least one of the machine and the elevator car door in response to the lockdown mode signal;

wherein when the lockdown mode signal is active, the controller controls operation of at least one of the machine and the elevator car door in response to a lockdown mode parameter;

wherein the controller moves the elevator car to stop in between landings in response to the lockdown mode parameter.

2. The elevator system of claim 1, wherein the lockdown mode parameter comprises an elevator car identifier parameter, the elevator car identifier parameter indicating at least one of: all elevator cars, groups of elevator cars or individually selected elevator cars.

3. The elevator system of claim 1, wherein the lockdown mode parameter comprises an elevator car travel parameter to control elevator car travel when lockdown mode is active.

4. The elevator system of claim 3, wherein the elevator car travel parameter indicates at least one of: stop at next available landing; stop at next called landing; recall to a specified landing, recall to lobby, travel between non-lockdown landings.

5. The elevator system of claim 1, wherein the lockdown mode parameter comprises an elevator car door parameter to control the elevator car door when lockdown mode is active.

6. The elevator system of claim 5, wherein the elevator car door parameter indicates at least one of: elevator car door remains closed; elevator car door remains opened; elevator car door closes and remains closed; elevator car door opens and remains open; elevator car door open button enable/disable; elevator car door close button enable/disable; remote elevator car door open button enable; remote elevator car door close button enable.

7. The elevator system of claim 1, wherein the lockdown mode parameter comprises an announcement parameter, the announcement parameter indicating whether an announcement is to be made.

8. The elevator system of claim 7, wherein the announcement parameter indicates at least one of: no announcement, an announcement throughout a facility and an announcement in the elevator car.

9. The elevator system of claim 1, wherein the lockdown mode parameter comprises a lockdown mode exit parameter, the lockdown mode exit parameter indicating operation of at least one of the machine and the elevator car door when the lockdown mode signal changes from active to inactive.

10. The elevator system of claim 1, further comprising a user interface configured to input the lockdown mode parameter.

11. The elevator system of claim 1, wherein the controller suspends operation of the machine and the elevator car door in response to the lockdown mode parameter.

12. The elevator system of claim 1, wherein the controller controls the machine to move the elevator car to a predetermined floor in response to the lockdown mode parameter.

13. The elevator system of claim 1, further comprising:

when the lockdown mode signal is inactive, exiting lockdown mode operation in response to the lockdown mode parameter.

14. The elevator system of claim 13, wherein the lockdown mode parameter comprises a lockdown mode exit parameter, the lockdown mode exit parameter indicating operation of at least one of the machine and the elevator car door when the lockdown mode signal changes from active to inactive.

* * * * *